US006588812B1

(12) United States Patent
Garcia et al.

(10) Patent No.: US 6,588,812 B1
(45) Date of Patent: Jul. 8, 2003

(54) ENHANCED TAMPER INDICATOR

(75) Inventors: Anthony R. E. Garcia, Espanola, NM (US); Roger G. Johnston, Los Alamos, NM (US)

(73) Assignee: The Regents of the University of California, Oakland, CA (US)

( * ) Notice: Subject to any disclaimer, the term of this patent is extended or adjusted under 35 U.S.C. 154(b) by 0 days.

(21) Appl. No.: 09/792,069

(22) Filed: Feb. 22, 2001

(51) Int. Cl.[7] ..... B65D 33/34

(52) U.S. Cl. ..... 292/307 R; 292/308; 292/307 A; 70/50

(58) Field of Search ..... 292/307 R, 308, 292/310, 316, 326, 307 A, 307 B, 315, 325; 70/50, 57.1, 440

(56) References Cited

U.S. PATENT DOCUMENTS

| | | | | | |
|---|---|---|---|---|---|
| 968,665 | A | * | 8/1910 | Humphrey | 292/307 R |
| 2,750,220 | A | * | 6/1956 | Keidel | 292/323 |
| 3,718,355 | A | | 2/1973 | Canter | 292/321 |
| 4,093,287 | A | | 6/1978 | Canter | 292/317 |
| 4,203,382 | A | * | 5/1980 | Mullen | 116/28 R |
| 4,333,210 | A | | 6/1982 | Burnett | 24/30.5 R |
| 4,365,833 | A | | 12/1982 | Burnett | 292/318 |
| 4,424,994 | A | | 1/1984 | Dowden | 292/318 |
| 4,471,982 | A | * | 9/1984 | Nielsen, Jr. | 292/307 B |
| 4,609,217 | A | * | 9/1986 | Nielsen et al. | 292/307 B |
| 4,680,882 | A | * | 7/1987 | Watson, Jr. | 292/307 R |
| 4,747,631 | A | * | 5/1988 | Loynes et al. | 24/136 A |
| 4,811,978 | A | * | 3/1989 | Wu | 292/323 |
| 4,898,412 | A | | 2/1990 | Wenk | 292/310 |
| 4,917,423 | A | | 4/1990 | Kohn | 292/324 |
| 4,936,612 | A | | 6/1990 | Kohn | 292/327 |
| 4,948,003 | A | * | 8/1990 | Munoz | 215/237 |
| 5,120,097 | A | | 6/1992 | Fattori et al. | 292/318 |
| 5,123,686 | A | | 6/1992 | Wenk | 292/321 |
| 5,125,700 | A | | 6/1992 | Fattori et al. | 292/318 |
| 5,147,070 | A | * | 9/1992 | Iwamoto | 222/83 |
| 5,482,176 | A | * | 1/1996 | Maietta et al. | 220/277 |
| 5,524,945 | A | * | 6/1996 | Georgopoulos et al. | 292/307 A |
| 5,871,243 | A | | 2/1999 | Wenk | 292/320 |
| 5,960,992 | A | * | 10/1999 | Bernstein et al. | 222/83.5 |
| 6,000,736 | A | * | 12/1999 | Leon et al. | 24/909 |
| 6,082,789 | A | | 7/2000 | Wenk | 292/320 |
| 6,131,969 | A | | 10/2000 | Natkins | 292/323 |
| 6,174,006 | B1 | * | 1/2001 | Burt | 292/307 A |
| 6,390,519 | B1 | * | 5/2002 | Dreisbach et al. | 242/388.1 |

* cited by examiner

*Primary Examiner*—William L. Miller
*Assistant Examiner*—Andre' L. Jackson
(74) *Attorney, Agent, or Firm*—Madson & Metcalf

(57) ABSTRACT

The present invention provides an apparatus and method whereby the reliability and tamper-resistance of tamper indicators can be improved. A flexible connector may be routed through a latch for an enclosure such as a door or container, and the free ends of the flexible connector may be passed through a first locking member and firmly attached to an insert through the use of one or more attachment members such as set screws. A second locking member may then be assembled in interlocking relation with the first locking member to form an interlocked assembly around the insert. The insert may have one or more sharp projections extending toward the first or second locking member so that any compressive force applied in an attempt to disassemble the interlocked assembly results in permanent, visible damage to the first or second locking member.

25 Claims, 3 Drawing Sheets

ENHANCED TAMPER INDICATOR

GOVERNMENT RIGHTS STATEMENT

This invention was made with Government support under Contract No. W-7405-ENG-36 awarded by the United States Department of Energy to The Regents of the University of California. The Government has certain rights in the invention.

BACKGROUND OF THE INVENTION

1. The Field of the Invention

The present invention relates to devices for indicating whether a safeguarded container has been tampered with. More specifically, the present invention relates to an enhanced tamper indicator with an insert to improve reliability and clearly indicate attempts to defeat the tamper indicator.

2. The Relevant Technology

Tamper indicators, or "seals," have become widely used in many applications in which it is desirable to know if tampering has occurred. For example, in enclosures such as restricted rooms, buildings, railcars, trucks, or the like, it is desirable to know if entry of some unauthorized person has been attempted. Similarly, many types of containers contain sensitive material for which it is desirable to know of any tampering attempts. Tamper indicators have been affixed to such containers or structures to provide evidence of tampering.

Some applications in which tamper indicators have been used include shipping, trucking, warehousing, retail security, nuclear materials management, corporate security, inventory control, preventing/detecting theft, protecting medical and consumer products, law enforcement and forensics, protecting blood banks and narcotics, counter-terrorism, banking, counter-intelligence, defense applications, preventing or detecting ballot box fraud, protecting instrument calibration, utility meters, liquor cabinets, nonproliferation, weapons control, hazardous material accountability, records integrity, and protecting specimens for testing for illegal drug use.

Tamper indicators typically are not made to prevent entry; rather, they are simply designed to leave clear evidence that entry, or an attempt at entry, has occurred. They may be used in combination with mechanical locks or other devices designed to delay or prevent entry. "Defeating" a tamper indicator thus is not simply obtaining access to the container or structure to which the indicator is attached, but rather obtaining access without visibly altering the tamper indicator. Those attempting to defeat a tamper indicator may attempt to deform the indicator to open it, and then return the indicator to its original state after opening the container. In the alternative, they may attempt to replace the tamper indicator with a counterfeit. Tamper indicators often have a unique serial number printed on one or both parts of the indicator to prevent counterfeiting.

One type of tamper indicator used in many government applications is the "metal cup seal," otherwise known as the "e-cup." The e-cup typically has a cup with an inward-curving flange and a cap with a series of locking arms that interlock with the flange. A cable, wire, or string is looped through the hasp or some other latch mechanism of the container or structure, and both ends of the cable, wire, or string are inserted through holes in the cap and knotted or crimped into a piece of copper. The cap and cup are then assembled so that the locking arms and the flange interlock, and the cap and cup are difficult to separate without breaking the locking arms or otherwise visibly damaging the cup or cap. Thus, anyone attempting to enter the container must either cut the cable, wire, or string, or detach one or both ends of the wire, cable, or string from within the cup and cap. In an attempt to disassemble the cup and cap, pressure may be applied to deform the cup and cap in various ways.

Those attempting to defeat the indicator may attempt to pull the end of the cable, wire, or string from its crimping engagement, without detaching the cap from the cup, and replace the wire, cable, or string after entry. In the alternative, they may attempt to deform the cup and/or cap to disassemble them and then deform them again to return them to their original appearance and reassemble them.

Many other types of tamper indicators operate on a similar principle. Some share the basic cup-and-cap structure of the e-cup, such as the double e-cup. Some, such as the computer-chip e-cup, have built-in electronic status indicating mechanisms such as computer-readable transmitters and chips. Others utilize the same wire, cable, or string structure, but capture the ends of the wire, cable, or string in different ways. All such tamper indicators could be improved by providing a more secure attachment to the wire, cable, or string, and by providing some mechanism to ensure that permanent deformation occurs when there is an attempt to access the ends of the wire, cable, or string.

Accordingly, a need exists for an apparatus and method whereby the resistance to tampering of tamper indicators, and particularly e-cups, can be enhanced. More specifically, it would be an advancement in the art to provide an apparatus and method for more securely engaging the wire, cable, or string ends within the comparatively small space inside a tamper indicator. Additionally, it would be an advancement in the art to provide an apparatus and method for permanently deforming the tamper indicator when a compressive load is applied to the tamper indicator, so that the tamper indicator cannot successfully be returned to its original state after tampering has occurred. A tamper indicator incorporating such an apparatus and method should preferably be cost-effective and simple to manufacture, easy to attach to a container or structure, and easy to check for signs of tampering.

BRIEF SUMMARY OF THE INVENTION

The apparatus of the present invention has been developed in response to the present state of the art, and in particular, in response to the problems and needs in the art that have not yet been fully solved by currently available tamper indicators. Thus, it is an overall objective of the present invention to provide an apparatus and method for enhancing the reliability of tamper indicators.

To achieve the foregoing objects, and in accordance with the invention as embodied and broadly described herein in the preferred embodiment, a tamper indicator having a tamper-resistant insert is provided. The tamper indicator may comprise a flexible connector, which may take the form of a wire, cable, or string that can be looped through the latch of a container or door. First and second ends of the flexible connector may then be attached within an interlocked assembly that includes a first locking member and a second locking member configured to be easily and irreversibly assembled. The first and second locking members may take the form of the cap and cup of the e-cup insert, or may be configured in some other mutually-engaging fashion.

The interlocked assembly may have an internal cavity within which the first and second ends of the flexible connector are fixed. The first and second ends may be inserted through first and second holes in the first locking member to enter the internal cavity.

The insert is preferably sized to fit within the internal cavity. Preferably, the insert is configured to receive the first and second ends of the flexible connector. An attachment member may be provided in addition to the insert, and may be used to affix the first and/or second ends to the insert. The attachment member may, for example, take the form of a rigid mechanical fastener such as a bolt, clamp, or set screw. In the alternative, the attachment member may be a formable attachment agent such as an adhesive, solder, or welding material. As yet another alternative, an attachment member need not be provided; the first and second ends may be knotted to each other or knotted separately to keep them attached to the insert.

In one configuration, one attachment member is used for each of the first and second ends of the flexible connector. The attachment members take the form of first and second set screws. The insert may then have a main body with a first hole and a second hole into which the first and second ends of the flexible connector can be attached. First and second transverse holes intersect the first and second holes, respectively, and are configured to receive the set screws. Thus, the first and second set screws can be screwed into the first and second transverse holes to press against the first and second ends of the flexible connector, respectively, so that the first and second ends are held firmly within the first and second holes.

The gripping force of the first and second set screws is measurable, reproducible, and reliable. Consequently, their use provides a significant advantage over the crimping methods used in the prior art. An intruder is unable to forcefully remove the first or second ends from the insert without causing visible damage to the interlocked assembly. Furthermore, the set screws can provide attachment with a minimum of tooling and effort.

In addition, the insert preferably has one or more sharp projections extending from the main body to impinge against the first or second locking members when any compressive force is applied to the first and second locking members. More specifically, the insert may have a generally cylindrical shape with a smaller section toward the first locking member and a larger section toward the second locking member. The smaller section may have a first face with a circular shape facing the first locking member. A first plurality of sharp projections may be positioned on the first face, and may extend to within a selected distance from the first locking member.

Similarly, the larger section may have a second face with a circular shape. A second plurality of sharp projections may be disposed on the second face, and may extend to within a selected distance from the second locking member. Thus, if the first or second locking member is bent, the bent locking member will contact the sharp projections, and the sharp projections will indent or even puncture the bent locking member in a manner that is very difficult to eradicate and easy to see from outside the interlocked assembly. For this application, the term "deform" includes indentation and puncturing.

If desired, sharp projections may be applied to the rounded sides of the insert to laterally contact the first or second locking member. In such a manner, the amount of visible deformation caused by the sharp projections during an attempt to defeat the tamper indicator may be increased.

An annular abutment may exist between the smaller and larger sections, and may be oriented parallel to the first and second faces. The annular abutment may serve to ensure that the sharp projections do not impinge against the interlocked assembly when tampering has not occurred.

Such an insert may be easily manufactured in a number of ways. If desired, the sharp projections and the main body may be integrally formed through a process such as stamping or molding. However, the main body and sharp projections are preferably formed separately. For example, the main body may be turned, molded, or otherwise formed from copper, brass, cold-rolled steel, or a comparatively hard plastic. Then, hardened steel spikes may be pressed or otherwise inserted into the main body to form the sharp projections.

Such a tamper indicator may be installed by performing a number of simple steps. First, the flexible connector may be looped through the latch or hasp of the container or structure, and the first and second ends may be inserted through one or two holes formed in the first locking member. The first and second ends may then be inserted into the first and second holes of the insert, and the first and second set screws may be screwed into the first and second transverse holes until they press against the first and second ends to hold them in place.

The first locking member may then be allowed to drop onto the insert such that the annular abutment of the insert supports the first locking member. The second locking member may then be aligned with the first locking member and the first and second locking members may be pressed gently together so that the flange and locking arms bend to slide past each other. The first and second locking members are then interlocked to form the interlocked assembly around the insert.

Any attempts to deform the interlocked assembly will then cause the sharp projections to press against the first or second locking member to form visible indentations or puncture holes. The indentations or holes are difficult to remove, and are easily noticeable upon brief inspection of the exterior of the interlocked assembly. Consequently, an intruder is unable to deform the first or second locking member in any temporary way to defeat the tamper indicator.

These and other objects, features, and advantages of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained will be readily understood, a more particular description of the invention briefly described above will be rendered by reference to specific embodiments thereof which are illustrated in the appended drawings. The advancements of the invention are depicted in conjunction with an e-cup; however, those of skill in the art will recognize that the system and method presented herein may be used with a wide variety of tamper indicators besides the e-cup. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
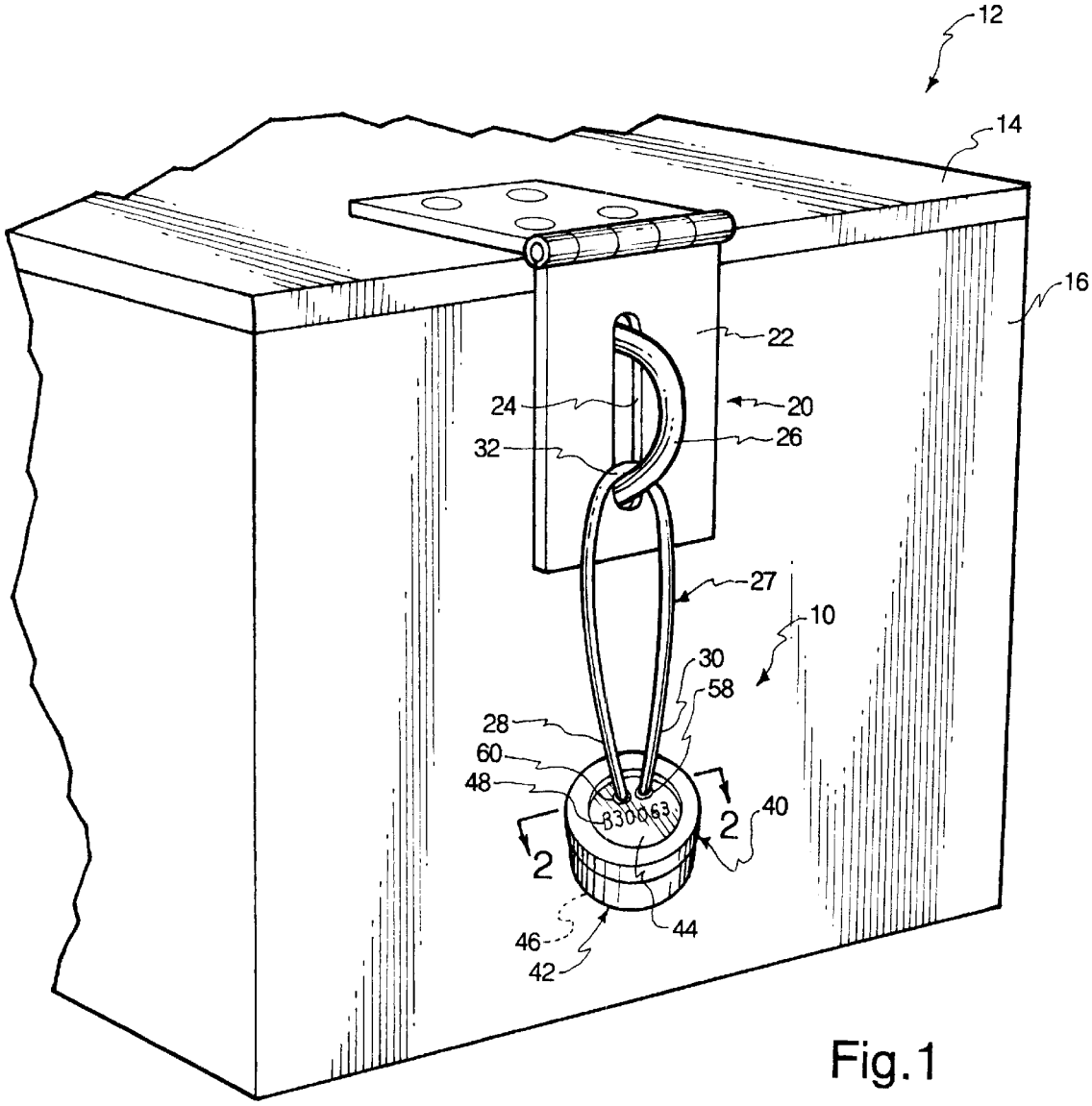
FIG. 1 is a perspective view of one embodiment of a tamper indicator according to the invention in its fully assembled state to indicate attempts to open a container.
Figure 2:
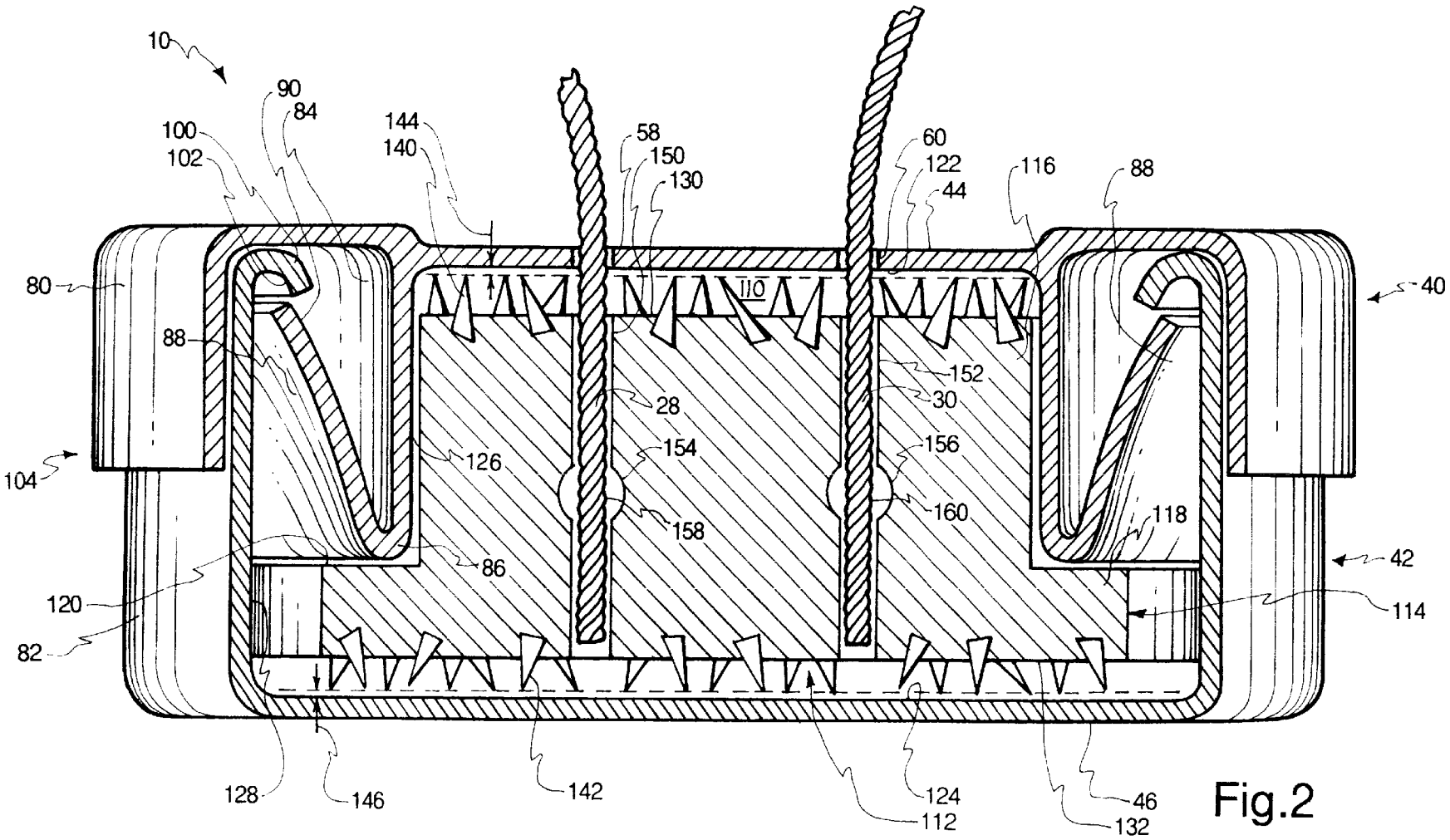
FIG. 2 is a side elevation, section view of the fully assembled tamper indicator of FIG. 1.
Figure 3:
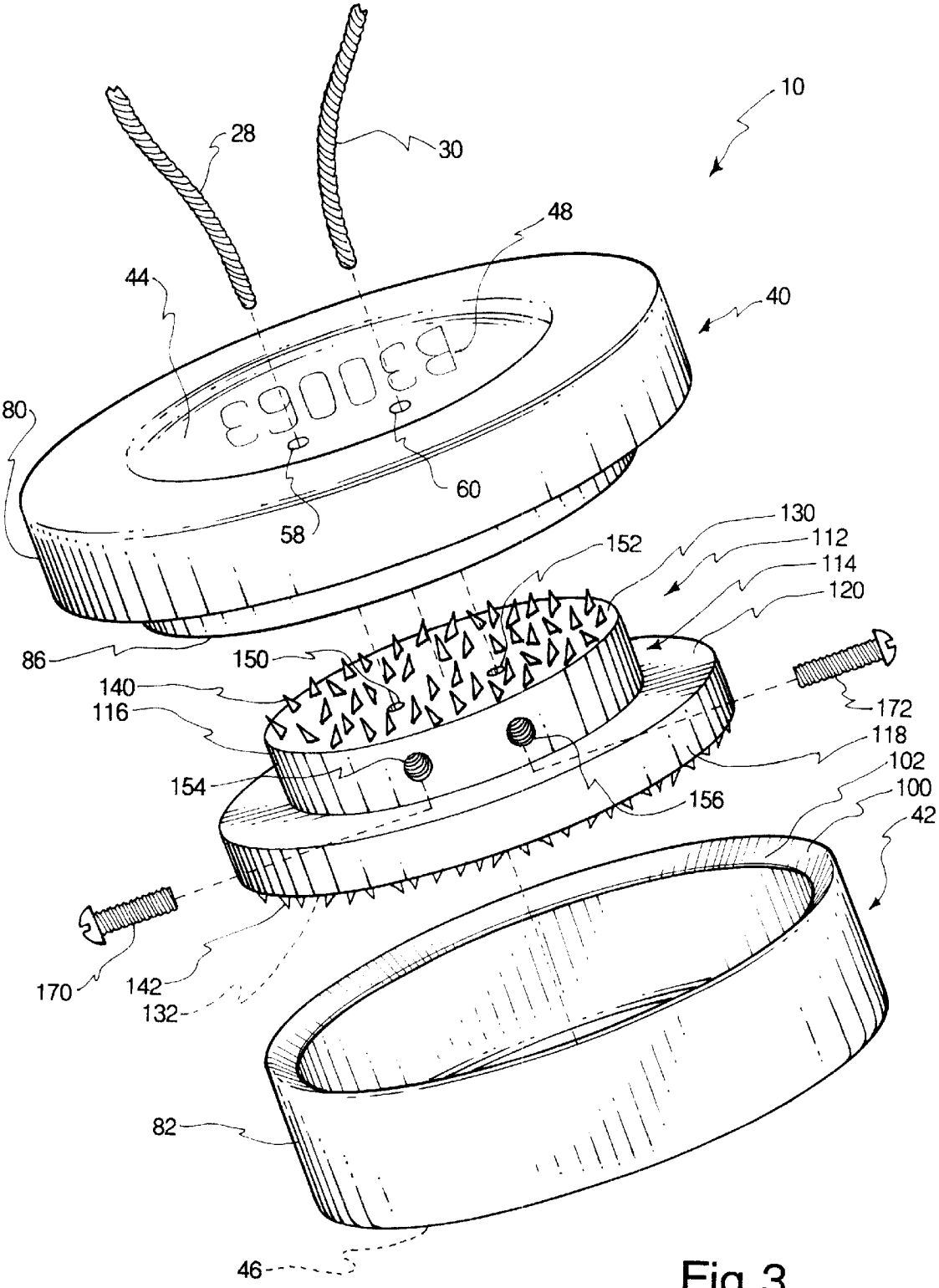
FIG. 3 is a perspective, exploded view of the tamper indicator of FIG. 1, depicting one possible method of installing and assembling the tamper indicator.

The presently preferred embodiments of the present invention will be best understood by reference to the drawings, wherein like parts are designated by like numerals throughout. It will be readily understood that the components of the present invention, as generally described and illustrated in the figures herein, could be arranged and designed in a wide variety of different configurations. Thus, the following more detailed description of the embodiments of the apparatus, system, and method of the present invention, as represented in FIGS. 1 through 3, is not intended to limit the scope of the invention, as claimed, but is merely representative of presently preferred embodiments of the invention.

The present invention provides a number of benefits over the prior art, one of which is more secure capturing of the ends of the flexible connector. More specifically, the present invention provides an installation apparatus and method by which each end of the connector can be held with a more precisely known and controlled frictional force. The frictional force tending to keep one object form moving along the surface of another object is proportional to the frictional coefficient of the interface between the two objects and the normal force, or the force tending to press the two objects together. Thus, if the normal force is subject to large variation, the frictional force is similarly subject to large variation.

Many known tamper indicators hold the ends of a cable, wire, or string through a simple method such as crimping or knotting. For example, one or both ends of the cable, wire, or string may be inserted into a copper piece with a split ring shape, and the copper piece may be compressed around the cable, wire, or string through the use of pliers or a special crimping tool. Unfortunately, the force applied to compress the copper piece may vary considerably form one installation to the next, so that differing normal forces are applied against the wire, cable, or string. Thus, the resulting frictional forces that determine the strength of the attachment will also vary. The same problem exists with tamper indicators in which the ends of the cable, wire, or string are simply knotted together without any type of insert.

The present invention provides more secure attachment through the use of a separate attachment member, the application of which can be more readily determined and measured. Set screws, in particular, provide a readily determinable normal force against the flexible connector because a specific number of turns can be applied to the set screw so that the end of the set screw that impinges against the flexible connector will be at a known position. Thus, the flexible connector can be consistently attached from one tamper indicator installation to the next.

The present invention also utilizes the mechanics of materials, and more specifically, material deformation, to enhance the effectiveness of tamper indicators by making the tamper indicators more difficult to deform in any non-permanent way. Generally, the stress on an object is equal to the force applied against it divided by the area over which the force is applied. The resultant deformation of the object is equal to the stress divided by the elastic modulus of the object (Young's Modulus). Thus, comparatively large deformations can be obtained by forces acting over smaller areas, especially when the forces are large. The same principle applies to objects such as cleats and studded snow tires. Traction is enhanced because the spikes or studs concentrate force into a small area, so that deeper penetration occurs.

Consistent with this principle, the present invention provides an insert for a tamper indicator with a plurality of sharp projections, each of which has a tip with a comparatively small cross-sectional area. The tips are harder than the material of the locking members. Consequently, when an attempt is made to defeat the tamper indicator, the projections impinge against the locking members. The force of each of the sharp projections is concentrated into a comparatively small portion of the locking member. Since the sharp projections have the higher hardness, small indentations or puncture marks are formed in the locking member to show that tampering has occurred. While a larger indentation may possibly be eradicated through the use of pliers or similar tools, the magnitude of deformation in the small indentations is extensive enough that they cannot be erased by an intruder. Puncture marks, or holes, also cannot reasonably be hidden.

The application of the principles discussed above will be further clarified by the following description. Those of skill in the art will recognize that these principles can be applied in a wide variety of ways besides those specifically shown and described.

Referring to FIG. 1, one possible embodiment of a tamper indicator 10 according to the present invention is shown, fully assembled and affixed to a container 12 to indicate attempts at entry. The container 12 has been arbitrarily chosen; the tamper indicator 10 may be used with any type of enclosed space for which entry is to be monitored. Thus, an "enclosure" with which the tamper indicator 10 may be used includes a wide variety of containers, buildings, vehicles, and the like. The container 12, as shown, has a lid 14 covering a box 16. For other types of enclosed spaces, a door or other similar structure may take the place of the lid 14.

A latch 20, which may be configured as a hasp 20, is attached to the lid 14 and used to keep the lid 14 locked against the box 16. More specifically, the hasp 20 may have a hinge plate 22 configured to swing down against the box 16 so that a slot 24 formed in the hinge plate 22 swings around a locking ring 26 rigidly attached to the box 16. If desired, a lock (not shown) may be inserted into the locking ring 26 to provide a more substantial barrier to entry of the container 12. However, FIG. 1 depicts only the tamper indicator 10 in engagement with the locking ring 26.

The tamper indicator 10 includes a flexible connector 27, which may take the form of a wire, cable, string, cord, or other bendable structure. Preferably, the flexible connector 27 is structured such that mending of the flexible connector 27 is unreasonably difficult without showing some sign that the flexible connector 27 has been severed. The flexible connector 27 has a first end 28, a second end 30, and an intermediate portion 32. The first and second ends 28, 30 denote not just the absolute terminal ends of the flexible connector 27, but also include the adjoining portions of the flexible connector 27.

The first and second ends 28, 30 are preferably engaged within a first locking member 40. The intermediate portion 32 is looped through the locking ring 26 of the hasp 20 so that the hinge plate 22 cannot be lifted to open the container 12 without either breaking the flexible connector 27, or detaching the first end 28 or the second end 30 from within the first locking member 40.

The first locking member 40 is interlocked with a second locking member 42 so that the first and second ends 28, 30 of the flexible connector 27 are inaccessible. The first and second locking members 40, 42 may be constructed of a wide variety of materials, but softer metals such as copper and brass, or harder plastics, are preferred. The first locking member 40 may have a first face 44 with a comparatively flat, circular shape. The second locking member 42 may have a second face 46 facing opposite the first face 44. The first face 44 may have a serial number 48 imprinted thereon to clearly distinguish the tamper indicator 10 from other similar tamper indicators, including counterfeits. If desired, the name or logo of the organization utilizing the tamper indicator 10 may also be imprinted around the first face 44. A similar name or logo and serial number (not shown) may be imprinted on the second face 46.

A first hole 58 and a second hole 60 are formed in the first face 44, and the first and second-ends 28, 30 of the flexible connector 27 are inserted through the first and second holes 58, 60, respectively to obtain access to the interior of the first locking member 40. The first and second holes 58, 60 may be positioned slightly off-center on the first face 44 to accommodate the serial number 48.

As shown in FIG. 1, the first and second locking members 40, 42 take the form of a cap 40 and cup 42 for an e-cup. However, those of skill in the art will recognize that the insert provided by the present invention could be used or easily adapted to enhance the operation of a large variety of known tamper indicators, including double e-cups, computer chip e-cups, and a wide variety of tamper indicators that are not based on the cup-and-cap configuration. Snap seals, tag seals, bag seals, car seals, meter seals, tank seals, ball seals, padlock-type seals, flag seals, and valve seals are a few additional examples. Thus, the first and second locking members 40, 42 may vary widely from the configuration depicted in FIGS. 1, 2, and 3.

Referring to FIG. 2, a cross-sectional view of the e-cup of FIG. 1 is depicted, with the cross section taken through the first and second holes 58, 60, as shown in FIG. 1. Since the first and second holes 58, 60 have been positioned off-center to provide room for the serial number 48, the cross-section does not pass through the center of the first and second locking members 40, 42.

The first locking member 40 may have a first tubular flange 80 attached to the first face 44. Similarly, the second locking member 42 may have a second tubular flange 82 attached to the second face 46. Preferably, the first tubular flange 80 has an inside diameter slightly larger than the outside diameter of the second tubular flange 82, so that the second tubular flange 82 can nest within the first tubular flange 80.

The first locking member 40 may also have an interior tubular flange 84 coaxial with, but smaller than, the first tubular flange 80. The interior tubular flange 84 may have a distal end 86 toward the second locking member 42. A plurality of locking arms 88 may extend generally outward from the distal end 86 and away from the second locking member 42. Each of the locking arms may take the form of a thin, bendable member with a distal end 90 proximate the first face 44 and the first tubular flange 88.

The second tubular flange 82 may have a curved rim 100 toward the first locking member 40, and the curved rim 100 may have a distal end 102 pointing generally inward and toward the second face 46. The curved rim 100 is thus designed to irreversibly interlock with the locking arms 88 when the first and second locking members 40, 42 are pressed together so that an interlocked assembly 104 is formed. The locking arms 88 bend inward to permit passage of the curved rim 100. When the distal end 102 of the curved rim 100 has passed the distal end 90 of the locking arms 88, the locking arms 88 snap back into an undeflected state to block withdrawal of the curved rim 100. Thus, the first and second locking members 40, 42 are designed such that they cannot be disassembled non-destructively, i.e., without damage to the locking arms 88 or other parts of the interlocked assembly 104.

The interlocked assembly 104 consists of the first and second locking members 40, 42 in the interlocked state. When the first and second locking members 40, 42 are assembled, an internal cavity 110 is formed. Preferably, the first and second tubular flanges 80, 82 fit tightly enough together that the internal cavity 110 is accessible only through the first and second holes 58, 60. An insert 112 rests within the internal cavity 110. The insert 110 may have a main body 114 with a substantially cylindrical shape. The main body 114 may be constructed of a wide variety of materials; however, metals such as copper, brass, and cold-rolled steel are preferable. The main body 114 may be formed by milling, turning, stamping, molding, or the like.

The main body 114 may have a smaller section 116 toward the first locking member 40 and a larger section 118 toward the second locking member 42. The smaller section 116 has a diameter smaller than the interior tubular flange 84 so that the smaller section 116 fits within the interior tubular flange 84. Similarly, the larger section 118 has a diameter smaller than the second tubular flange 82 so that the larger section 118 fits within the second tubular flange 82. An annular abutment 120 between the smaller section 116 and the larger section 118 faces toward the first locking member 40 and may abut the distal end 86 of the interior tubular flange 84.

The main body 114 may thus be positioned proximate a plurality of interior surfaces of the interlocked assembly 104. For example, the first and second locking members 40, 42 may have first and second flat interior surfaces 122 and 124, inward of the first and second faces 44, 46, respectively. Furthermore, the first and second locking members 40, 42 may have first and second cylindrical interior surfaces 126 and 128 on the insides of the interior tubular flange 84 and the second tubular flange 82, respectively. Other interior surfaces within the interlocked assembly 104 may also be affected by the operation of the insert 112.

The smaller section 116 may have a first face 130 facing the first flat interior surface 122 of the first locking member 40. Similarly, the larger section 118 may have a second face 132 facing the second flat interior surface 124 of the second locking member 42. The first face 130 has at least one, and preferably a plurality, or first plurality, of sharp projections 140 extending from the first face 130 toward the first locking member 40.

The first plurality of sharp projections 140 may be integrally formed with the main body 114, if desired. Preferably, the sharp projections 140 comprise spikes constructed of hardened steel and affixed to the first face 130. However, the sharp projections 140 need not be steel, but may be composed of any material harder than the material of the first locking member 40. "Sharp" simply denotes the existence of a tip with a comparatively small cross-section to minimize the area over which pressure acts; the sharp projections 140 may have a small diameter rounded tip or the like, rather than a point, if desired. If the sharp projections 140 are harder than the main body 114, the sharp projections 140 preferably have larger cross sectional area abutting the main body 114, so that pressure against the tips of the sharp projections 140 does not simply embed them further into the main body 114.

For example, the sharp projections 140 may be welded, glued, soldered, brazed, interference fitted, or the like into holes formed in the first face 130. In the alternative, particularly where the main body 114 is constructed of a softer material such as brass or copper, the sharp projections 140 may be pressed into the first face 130 without pre-forming holes in the first face 130. In such a case, the sharp projections 140 may remain seated in the first face 130 without application of any other attachment methods.

The sharp projections 140 may be oriented at a wide variety of random angles. Thus, the action of sharp projections 140 can be made less predictable to an intruder, and the sharp projections 140 can impinge upon the first locking member 40 when the first locking member 40 is deformed in a lateral, or sideways, fashion.

A second plurality of sharp projections 142 may also extend from the second face 132 toward the second locking member 42. The second plurality of sharp projections 142 may be structured and/or attached in any of the ways described in connection with the first plurality of sharp projections 140. The sharp projections 142 may also be oriented at a wide variety of random angles.

Preferably, the first plurality of sharp projections 140 is separated from the first flat interior surface 122 of the first locking member 40 by a first distance 144 large enough to ensure that the sharp projections 140 do not indent the first locking member 40 during installation or use of the tamper indicator 10. The first distance 144 is also preferably small enough that a comparatively small deformation of the first locking member 40 is required to induce contact between the sharp projections 140 and the first locking member 40, so that even somewhat gentle tampering leaves a visible sign. The second plurality of sharp projections 142 is preferably separated from the second flat interior surface 124 of the second locking member 42 by a second distance 146 selected according to the considerations described above. "Visible deformation" refers to deformation of the interlocked assembly 104 that can be seen from outside the interlocked assembly 104 with the naked eye. Such deformation includes indentations, puncture holes, and the like.

In addition to the sharp projections 140, 142 on the first and second faces 130, 132, the insert 112 may have sharp projections (not shown) protruding from other locations. For example, if desired, sharp projections could be attached to the rounded wall of the larger section 118 to impinge against the second cylindrical interior surface 128 under lateral compression of the second locking member 42. Similarly, sharp projections could be attached to the rounded wall of the smaller section 116 facing the first cylindrical interior surface 126. However, indentations or puncture holes formed in the interior tubular flange 84 would most likely not be visible from outside the interlocked assembly 104.

The first and second ends 28, 30 of the flexible connector 27 may be affixed to the insert 112 in a wide variety of ways according to the invention. An attachment member is used to provide more secure and predictable attachment. The term "attachment member" includes any separate item used to fasten two other items together, including both rigid mechanical fasteners and formable attachment agents.

A "rigid mechanical fastener" includes any rigid attachment member that accomplishes attachment mechanically, i.e., by exerting pressure against the two other items to provide frictional engagement. For example, bolts, nuts, screws, clips, clamps, and the like are rigid mechanical fasteners.

A "formable attachment agent" includes any fluid or malleable solid that can be used to affix the two other items together. Chemical and adhesive bonding, soldering, and brazing are all examples of processes that utilize formable attachment agents. The formable attachment agent may thus be a glue, solder, welding material, brazing solder, or the like.

For the embodiment of FIG. 2, set screws (shown in FIG. 3) are the preferred attachment members. The insert 112 may therefore have a first hole 150 and a second hole 152 formed in the main body 114 thereof. Preferably, the first hole 150 and the second hole 152 are positioned such that they can be aligned with the first and second holes 58, 60, respectively, in the first face 44 of the first locking member 40. The first and second holes 150, 152 are thus positioned to receive the first and second ends 28, 30 of the flexible connector 27, respectively. The first and second holes 58, 60 need not extend to the second face 132 of the insert 112, as depicted.

First and second transverse holes 154, 156 may also be formed in the main body 114 of the insert 112 in such a position that they intersect the first and second holes 150, 152. The first and second transverse holes 154, 156 may also be perpendicular to the first and second holes 150, 152, as shown, or may intersect the first and second holes 150, 152 at some other angle. The first and second transverse holes 154, 156 may be threaded, or the set screws may be of a self-tapping variety. In either case, the set screws may be screwed into the first and second transverse holes 154, 156 to press against the first and second ends 28, 30, respectively, of the flexible connector 27. The first and second ends 28, 30 may thus have a first compressed portion and a second compressed portion 158, 160, respectively, where the set screws press against them.

The set screws provide numerous advantages over previously used attachment methods. For example, the set screws can easily be rotated to a pre-selected tightness to provide the proper amount of force against the first and second ends 28, 30 of the flexible connector 27. Thus, the first and second ends 28, 30 will consistently be retained with a force sufficient to resist withdrawal from the insert 112 by an intruder. Additionally, the set screws tend to remain in comparatively tight engagement over time, while crimped connections and the like may relax somewhat over prolonged use.

In operation, the insert 112 enhances the tamper-resistance of the tamper indicator 10 in a number of ways. An intruder may apply compressive force, i.e., press the first and second locking members 40, 42 together directly or laterally (in a sideways direction) in an effort to open the interlocked assembly 104. The compressive force will either bend the first face 44 to cause the first plurality of sharp projections 140 to impinge against the first flat interior surface 122, or press the second plurality of sharp projections 142 to impinge against the second flat interior surface 124. In either case, indentations or puncture marks are formed in the flat interior surfaces 122, 124 that can be readily seen as bumps or holes on the first face 44 or the second face 46. Attempts to pull the first or second ends 28, 30 of the flexible connector 27 from the interlocked assembly 104 will likewise be unfruitful, may also cause the visible deformation of the interlocked assembly 104.

Referring to FIG. 3, an exploded view of the tamper indicator 10 is shown to illustrate how the tamper indicator 10 may be assembled. The first and second ends 28, 30 of the flexible connector 27 may first be inserted through the first and second holes 58, 60, respectively, in the first locking member 40. Then, the first and second ends 28, 30 may be inserted into the first and second holes 150, 152 of the insert 112.

After the first and second ends 28, 30 are in place, the set screws 170, 172 may be screwed into the first and second transverse holes 154, 156, respectively, and turned to the proper tightness. The first and second set screws 170, 172 may thus be rotated a specified number of turns, or may be tightened to an established tightness to ensure that the first and second ends 28, 30 are properly retained. Preferably, the set screws 170, 172 have blunt ends to avoid damaging the compressed portions 158, 160 of the first and second ends 28, 30.

After the first and second ends 28, 30 of the flexible connector 27 have been secured to the insert 112, the first locking member 40 may be allowed to drop onto the insert 112 so that the distal end 86 of the interior tubular flange 84 rests on the annular abutment 120. The annular abutment 120 effectively prevents the first plurality of sharp projections 140 from damaging the first locking member 40 during assembly.

The second locking member 42 may then be aligned with the first locking member 40, and the first and second locking members 40, 42 may be pressed gently together until the curved rim 100 has slid past the locking arms 88, and the locking arms 88 have snapped back into an undeflected position.

The tamper indicator 10 is then fully assembled, and may be quickly and easily checked for attempts at unauthorized access. An inspector must simply examine the interlocked assembly 104 for signs of deformation. If there are small bumps or puncture holes on the first or second faces 44, 46, or on any other part of the interlocked assembly 104 proximate sharp projections of the insert 112, it will be clear that there has been an attempt to defeat the tamper detector 10. Similarly, if the serial number 48 is incorrect, the inspector will know that some part of the interlocked assembly 104 has been replaced.

The configuration of the insert 112 may be adapted in a number of ways for use with other tamper indicator configurations. For example, the insert 112 may be made smaller or larger, the smaller and larger sections 116, 118 may be made a uniform size, the insert 112 may have a rectangular prizmoidal shape, or the like, depending on the configuration of the tamper indicator to be used. Procedures for installing an insert similar to the insert 112 in other tamper indicators may be quite similar to those described in connection with FIG. 3. Similarly, inspection procedures may be quite similar; one or more small bumps on the exterior of the tamper indicator show that an attempt at unauthorized entry has been made.

The insert 112 of the present invention provides numerous advantages over known tamper indicators. The ends 28, 30 of the flexible connector 27 can be more consistently and reliably retained through the use of the set screws 170, 172. Additionally, attempts to open the interlocked assembly 104 through any type of deformation may be rapidly and easily detected. The small area over which the force of the sharp projections 140, 142 is applied causes deformation extreme enough that it cannot reasonably be repaired by an intruder to cover up an attempted entry.

The present invention may be embodied in other specific forms without departing from its structures, methods, or other essential characteristics as broadly described herein and claimed hereinafter. The described embodiments are to be considered in all respects only as illustrative, and not restrictive. The scope of the invention is, therefore, indicated by the appended claims, rather than by the foregoing description. All changes that come within the meaning and range of equivalency of the claims are to be embraced within their scope.

What is claimed and desired to be secured by United States Letters Patent is:

1. A tamper indicator comprising:

a first locking member;

a second locking member configured to interlock with the first locking member to form an interlocked assembly resistant to non-destructive disassembly of the first and second locking members, the interlocked assembly having an internal cavity; and an insert shaped to fit within the internal cavity, the insert contacting an interior surface of the interlocked assembly to induce visible deformation of the first locking member when compressive force is applied to the interlocked assembly.

2. The tamper indicator of claim 1, wherein the first locking member comprises a plurality of locking arms, and wherein the second locking member comprises a curved rim, the locking arms interlocking with the curved rim upon assembly of the first and second locking members to form the interlocked assembly.

3. The tamper indicator of claim 1, wherein the insert comprises a first plurality of sharp projections oriented toward the interior surface to induce visible deformation when urged against the interior surface.

4. The tamper indicator of claim 3, wherein the interior surface comprises a flat interior surface of the first locking member.

5. The tamper indicator of claim 4, wherein the insert further comprises an annular abutment configured to abut the first locking member to restrict deformation of the flat interior surface by the sharp projections in the absence of compressive force against the interlocked assembly.

6. The tamper indicator of claim 5, wherein the insert further comprises a second plurality of sharp projections oriented toward a flat interior surface of the second locking member.

7. The tamper indicator of claim 1, wherein the insert comprises:

a main body shaped to fit within the internal cavity of the tamper indicator; and a sharp projection extending outward from the main body, the sharp projection being configured to visibly deform the interlocked assembly when compressive force is applied to the interlocked assembly.

8. The tamper indicator of claim 7, wherein the sharp projection comprises a spike formed of a material harder than the main body, the spike being formed separately from the main body and attached thereto.

9. A tamper indicator for indicating attempts to open an enclosure, the tamper indicator comprising:

an interlocked assembly having an internal cavity and a hole providing access to the internal cavity from outside the interlocked assembly;

a flexible connector having a first end, a second end, and an intermediate portion, the intermediate portion being interlocked with the enclosure to resist opening of the enclosure without breaking the flexible connector;

an insert shaped to fit within the internal cavity; and an attachment member configured to engage the insert to secure the first end of the flexible connector to the insert.

10. The tamper indicator of claim 9, wherein the attachment member comprises a rigid mechanical fastener.

11. The tamper indicator of claim 10, wherein the rigid mechanical fastener comprises a first set screw.

12. The tamper indicator of claim 11, wherein the insert comprises:

a first hole sized to receive the first end of the flexible connector; and a first transverse hole intersecting the first hole, the first transverse hole being configured to receive the first set screw such that the first set screw presses against the first end of the flexible connector to keep the first end of the flexible connector within the first hole.

13. The tamper indicator of claim 12, wherein the insert further comprises:

a second hole sized to receive the second end of the flexible connector;

a second set screw; and a second transverse hole intersecting the second hole, the second transverse hole being configured to receive the second set screw such that the second set screw presses against the second end of the flexible connector to keep the second end of the flexible connector within the second hole.

14. The tamper indicator of claim 9, wherein the attachment member comprises a formable attachment agent.

15. The tamper indicator of claim 14, wherein the attachment agent is chosen from the group consisting of adhesives, solder, brazing solder, and welding material.

16. A method for providing evidence of an attempt to open an enclosure, the method comprising:

providing a first locking member;

providing a second locking member;

providing an insert;

providing a flexible connector having a first end, a second end, and an intermediate portion;

interlocking the flexible connector with the enclosure to restrict opening of the enclosure without breaking the flexible connector;

inserting the first and second ends of the flexible connector through the first locking member;

affixing the first and second ends of the flexible connector to the insert; and interlocking the first and second locking members around the insert to form an interlocked assembly resistant to non-destructive disassembly of the first and second locking members, the interlocked assembly containing the insert such that the insert is positioned to visibly deform an interior surface of the interlocked assembly when compressive force is applied to the interlocked assembly.

17. The method of claim 16, wherein inserting the first and second ends of the flexible connector through the first locking member comprises:

forming a first hole and a second hole in the first locking member;

inserting the first end of the flexible connector through the first hole; and inserting the second end of the flexible connector through the second hole.

18. The method of claim 16, wherein affixing the first and second ends of the flexible connector to the insert comprises:

forming a first hole and a second hole in the insert;

inserting the first end of the flexible connector through the first hole; and inserting the second end of the flexible connector through the second hole.

19. The method of claim 18, wherein affixing the first and second ends of the flexible connector to the insert further comprises:

forming a first transverse hole intersecting the first hole and a second transverse hole intersecting the second hole;

providing a first set screw and a second set screw;

screwing the first set screw into the first transverse hole to press against the first end of the flexible connector to keep the first end of the flexible connector within the first hole; and screwing the second set screw into the second transverse hole to press against the second end of the flexible connector to keep the second end of the flexible connector within the second hole.

20. The method of claim 16, wherein providing an insert comprises:

providing a main body having a first face configured to be positioned proximate the first locking member; and providing a first plurality of sharp projections affixed to the first face and oriented toward the first locking member, the first plurality of sharp projections resting proximate the first locking member when the first and second locking members are interlocked around the insert.

21. The method of claim 20, wherein providing an insert further comprises providing a second plurality of sharp projections affixed to a second face of the main body, the second face facing opposite the first face, the second plurality of projections being oriented toward the second locking member to rest proximate the second locking member when the first and second locking members are interlocked around the insert.

22. The method of claim 16, wherein providing a first locking member comprises:

forming an interior tubular flange of the first locking member, the interior tubular flange having a distal end; and forming a plurality of locking arms extending outward from the interior tubular flange.

23. The method of claim 22, wherein providing a second locking member comprises forming a curved rim of the second locking member, the curved rim being configured to interlock with the locking arms to form the interlocked assembly.

24. The method of claim 23, wherein providing an insert comprises providing a main body having an annular abutment configured to abut the first locking member to prevent deformation of the first locking member in the absence of compressive force against the interlocked assembly.

25. The method of claim 24, wherein interlocking the first and second locking members around the insert comprises:

positioning the insert such that the annular abutment abuts the distal end of the interior tubular flange of the first locking member;

aligning the second locking member with the first locking member and the insert; and pressing the first and second locking members together until the locking arms and the curved rim are interlocked.

* * * * *